US010271575B2

(12) United States Patent
Pozorski

(10) Patent No.: US 10,271,575 B2
(45) Date of Patent: Apr. 30, 2019

(54) STATION FOR TRAYS FILLED WITH ROD-LIKE ARTICLES AND APPARATUS FOR EMPTYING OF FOUR-WALL OR FIVE-WALL TRAY FILLED WITH ROD-LIKE ARTICLES OF THE TOBACCO INDUSTRY

(71) Applicant: International Tobacco Machinery Poland Sp. z o. o., Radom (PL)

(72) Inventor: Robert Pozorski, Radom (PL)

(73) Assignee: International Tobacco Machinery Poland Sp. z o. o., Radom (PL)

( * ) Notice: Subject to any disclaimer, the term of this patent is extended or adjusted under 35 U.S.C. 154(b) by 0 days.

(21) Appl. No.: 15/696,917

(22) Filed: Sep. 6, 2017

(65) Prior Publication Data

US 2018/0084824 A1 Mar. 29, 2018

(30) Foreign Application Priority Data

Sep. 28, 2016 (EP) ..... 16191240

(51) Int. Cl.
*A24C 5/352* (2006.01)
*B65D 19/04* (2006.01)
(Continued)

(52) U.S. Cl.
CPC ..... *A24C 5/352* (2013.01); *A24C 5/356* (2013.01); *B65B 19/04* (2013.01); *B65B 35/10* (2013.01)

(58) Field of Classification Search
CPC ..... A24C 5/35; A24C 5/356; A24C 5/352; B65B 19/04; B65B 35/10
See application file for complete search history.

(56) References Cited

U.S. PATENT DOCUMENTS 4,541,521 A 9/1985 Menge
4,856,958 A * 8/1989 Bantien ..... A24C 5/35 198/347.2
(Continued)

FOREIGN PATENT DOCUMENTS

DE 68909656 T2 5/1994
EP 1086628 A2 3/2001
(Continued)

OTHER PUBLICATIONS

European Search Report for application No. EP 16191240, completed Feb. 14, 2017.

*Primary Examiner* — Michael H. Wilson
*Assistant Examiner* — Dionne W Mayes
(74) *Attorney, Agent, or Firm* — Oppedahl Patent Law Firm LLC

(57) ABSTRACT

A station (2) for trays filled with rod-like articles (R), in a tobacco industry apparatus, provided with a receiving part (2A) to receive filled trays (3, 13); and a storage and conveying unit (2C) containing the filled trays (3, 13), provided with a conveyor (4) to convey the filled trays (3, 13) and a tray separation mechanism (4A) to separate the first tray (3', 13') from other trays (3, 13) collected on bearing elements (4D) of the conveyor (4), whereas the tray separation mechanism (4A) is provided with lifting elements (51, 51', 63, 63') adapted to lift the trays (3, 13) from the bearing elements (4D) of the conveyor (4); characterised in that further the station (2) is provided with lateral belts (56, 56') adapted to support the sidewalls (3L, 3R, 13L, 13R) of the tray (3, 13), whereas the lateral belts (56, 56') are adapted to perform a movement corresponding to the movement of the lifting elements (51, 51', 63, 63') when lifting the trays (3, 13) from the bearing elements (4D) and putting the trays (3, 13) on the bearing elements (4D). The object of the
(Continued)

application is also an apparatus for emptying of a four-wall or five-wall tray filled with the rod-like articles.

13 Claims, 6 Drawing Sheets

(51) Int. Cl.

| | |
|---|---|
| ***B65B 19/04*** | (2006.01) |
| ***A24C 5/356*** | (2006.01) |
| *B65B 35/10* | (2006.01) |

(56) References Cited

U.S. PATENT DOCUMENTS

| | | | |
|---|---|---|---|
| 6,517,306 | B1 | 2/2003 | Budney |
| 2006/0120839 | A1 | 6/2006 | Knabe |

FOREIGN PATENT DOCUMENTS

| | | | |
|---|---|---|---|
| EP | 1118543 | B1 | 6/2003 |
| EP | 1656841 | A1 | 5/2006 |
| EP | 2578092 | A2 | 4/2013 |
| WO | WO2015033264 | A1 | 3/2015 |

* cited by examiner

STATION FOR TRAYS FILLED WITH ROD-LIKE ARTICLES AND APPARATUS FOR EMPTYING OF FOUR-WALL OR FIVE-WALL TRAY FILLED WITH ROD-LIKE ARTICLES OF THE TOBACCO INDUSTRY

The object of the invention is a station for trays filled with rod-like articles and an apparatus for emptying of a four-wall or five-wall tray filled with rod-like articles of the tobacco industry.

Tobacco industry's factories manufacture various articles for smoking. Both finished and semi-finished products made at successive production stages may be jointly referred to as rod-like articles which may be transported on conveyors or in trays. Plastic trays which are used for all types of rod-like articles, among others for cigarettes, cigarillos, cigars and filter material rods, are commonly used in the tobacco industry. Plastic trays have the shape of a cuboid without two adjacent walls, i.e. these are trays having four walls. Plastic trays are rigid and are used for temporary storage and transport of rod-like articles on the premises of tobacco factories. Generally, cardboard trays designed as five-wall trays are commonly used for the transport of filter rods outside the factory premises. Cardboard trays have thinner walls, are less rigid and easily deformable, with one swinging wall. The filling of a five-wall tray takes place after opening of a tray i.e. after swinging the swinging wall. After the filling, the tray must be closed i.e. the swinging wall must be turned to its original position. The same swinging wall is swung in order to empty the tray. For the transport, the filled tray is covered with a lid in order to protect the rods collected inside.

Tray conveyors, for example on a tray unloader, work in the start-stop mode, whereas the trays are usually conveyed so that the conveying direction is perpendicular to the back wall of the tray. Thus the acceleration and the deceleration acting on the tray act perpendicular to the back wall of the tray causing the occurrence of a torque relative to the long side of the bottom wall that is the tray base, as a result of which the trays may easily fall over. The risk of the trays falling over increases with the decrease in length of the articles conveyed in the trays because the length of the short side of the bottom wall of the tray is related to the length of the articles. Usually the length of the short side of the bottom wall of the tray is slightly greater than the length of the articles. The length of both finished rod-like articles and semi-finished tobacco industry products is in the range between 60 and over 200 mm. In the case of the longest articles the risk of falling over does not occur at all, whereas it poses a big problem for the shortest articles with regard to the conveyor design and speed control because the distance of the tray's centre of gravity from the bottom wall of the tray is several times greater than the width of the bottom wall. The problem of unstable conveying of the tray emerges to the highest degree when cardboard trays, which themselves are non-rigid, are delivered for unloading, and conveying them in the perpendicular direction to the back wall of the tray involves the risk of tray falling over.

Apparatuses for emptying of five-wall cardboard trays are known from the documents EP1118543B1, WO2015033264A1. The document EP1118543B1 discloses an apparatus for automatic opening of closed cardboard trays with rod-like articles of the tobacco industry, having an opening segment, having a suction device, the apparatus being assigned to a cardboard tray feeder, for sucking and opening of the opening segment of the cardboard tray. The document WO2015033264A1 discloses an apparatus for emptying of trays containing rod-like articles of the tobacco industry comprising a conveyor unit to convey the trays in the direction of a tray emptying station and to pick up the trays from the tray emptying station. The conveyor unit is provided with a unit turning and locking the movable lid of the cardboard tray.

An apparatus for emptying of four-wall trays is known from EP1086628B1. The document EP1086628B1 discloses an apparatus for successive emptying of trays filled with rod-like articles of the tobacco industry, the said apparatus being placed in a frame in a feeding station, and then the filled trays being conveyed with the frame to an emptying station and being emptied there. After emptying the tray, it is conveyed back to the feeding station. At the feeding station a next filled tray, when transferring to the frame, removes, directly or indirectly, the empty tray situated in the frame.

The object of the invention is a station for trays filled with rod-like articles, in a tobacco industry apparatus, provided with a receiving part to receive filled trays; and a storage and conveying unit containing the filled trays, provided with a conveyor to convey the filled trays and a tray separation mechanism to separate the first tray from other trays collected on bearing elements of the conveyor, whereas the tray separation mechanism is provided with lifting elements adapted to lift the trays from the bearing elements of the conveyor. The station according to the invention is further characterised by being further provided with lateral belts adapted to support the sidewalls of the tray, whereas the side belts are adapted to perform a movement corresponding to the movement of the lifting elements when lifting the trays from the bearing elements and putting the trays on the bearing elements.

The station according to the invention is further characterised in that the lifting elements have the form of longitudinal bars or plates supporting bottom walls of the trays.

The station according to the invention is further characterised in that the lifting elements are adapted to make a swinging movement.

The station according to the invention is further characterised in that the tray separation mechanism is provided with a limiter for trays collected in the station, being coupled with the movement of the lifting elements.

The station according to the invention is further characterised in that the limiter is adapted to make a swinging movement.

The station according to the invention is further characterised in that the limiter is adapted to make a linear movement.

The station according to the invention is further characterised in that the lateral supporting belts are positioned convergently.

The station according to the invention is further characterised in that the lateral belts are positioned parallel to each other.

The station according to the invention is further characterised in that the conveyor is a belt conveyor.

The station according to the invention is further characterised in that the conveyor is a chain conveyor.

The station according to the invention is further characterised in that the speed of the lateral belts is synchronised with the speed of the bearing elements of the conveyor.

Furthermore, the object of the application is an apparatus for emptying of a four-wall tray or a five-wall tray filled with the rod-like articles of the tobacco industry, whereas the upper wall of the five-wall tray is a swinging wall, provided with a filled tray station, a turning unit to turn the filled tray, a lifting unit to lift the turning unit, a filled tray emptying station and an empty tray station. The apparatus according to the invention is further characterised in that the station is provided with lateral belts adapted to support the lateral walls of the tray, whereas the lateral belts are adapted to make a movement corresponding to the movement of the lifting elements when lifting the trays from the bearing elements and putting the trays on the bearing elements.

The apparatus according to the invention facilitates safe conveying of the trays, the risk of tray falling over being minimised, so that the number of stoppages of the tray unloaders caused by spilling of the articles has been minimised. Moreover, the production losses resulting from falling over of trays with a small depth have been minimised because the spilled articles are usually thrown away.

The object of the invention was shown in detail in a preferred embodiment in a drawing in which.

Figure 1:
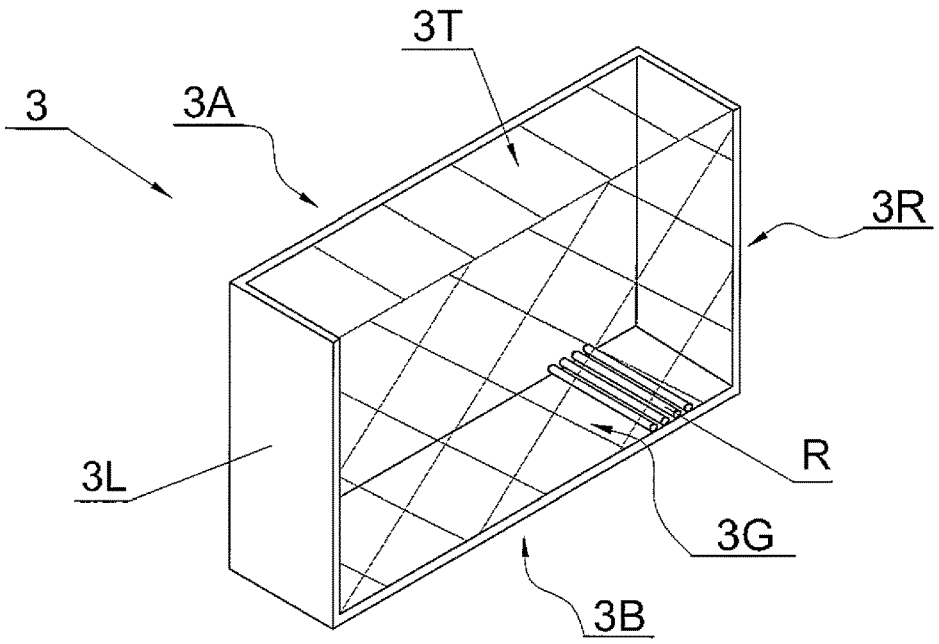
FIG. 1 shows a filled four-wall tray (of the second type) in a perspective view, the front side of the tray being visible.
Figure 2:
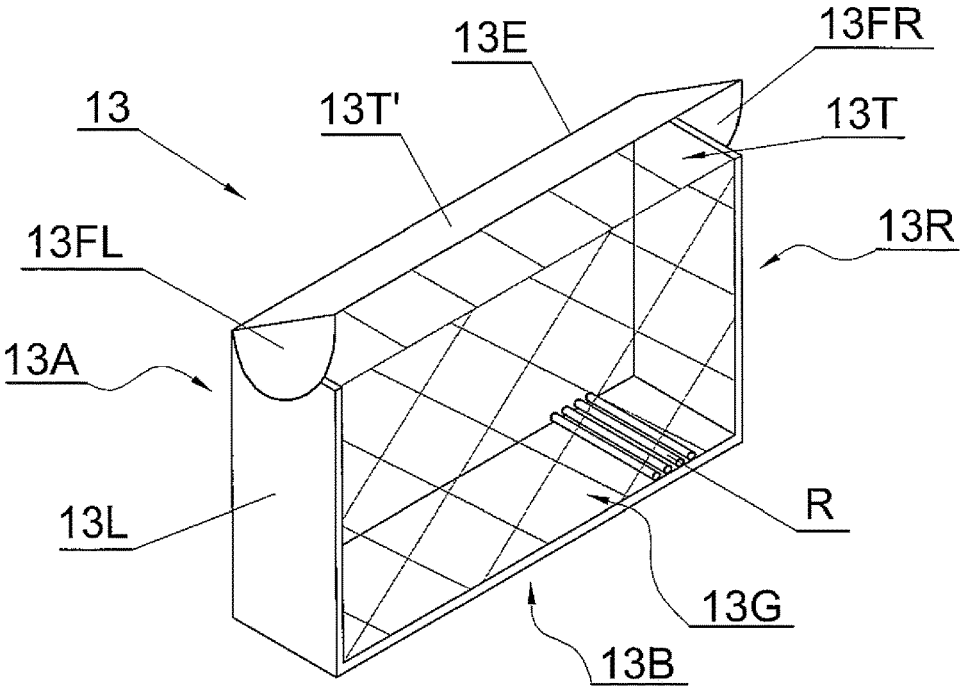
FIG. 2 shows a filled five-wall tray (of the first type) in a perspective view, the front side of the tray being visible.
Figure 2A:
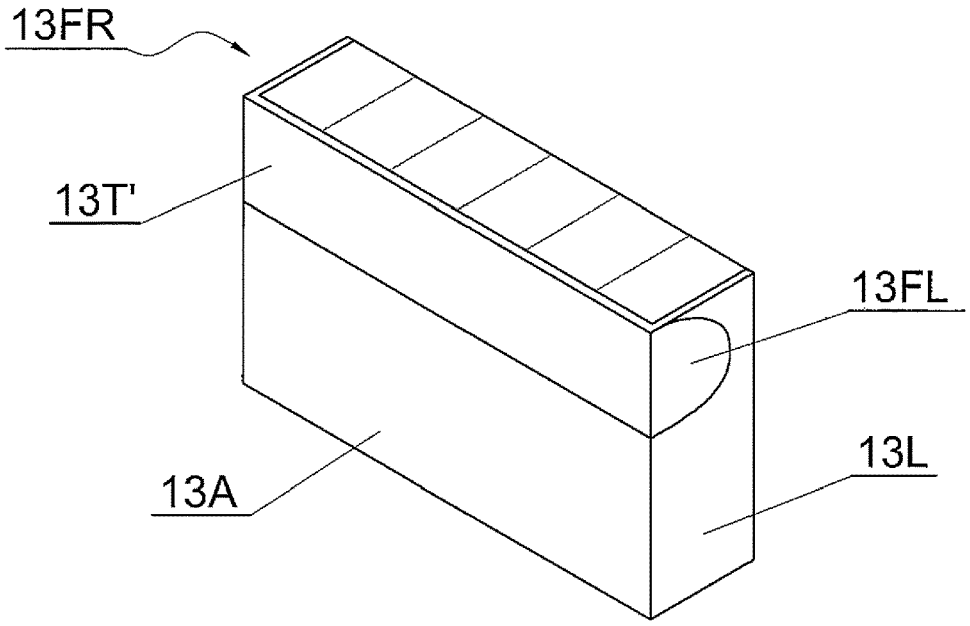
Figure 2B:
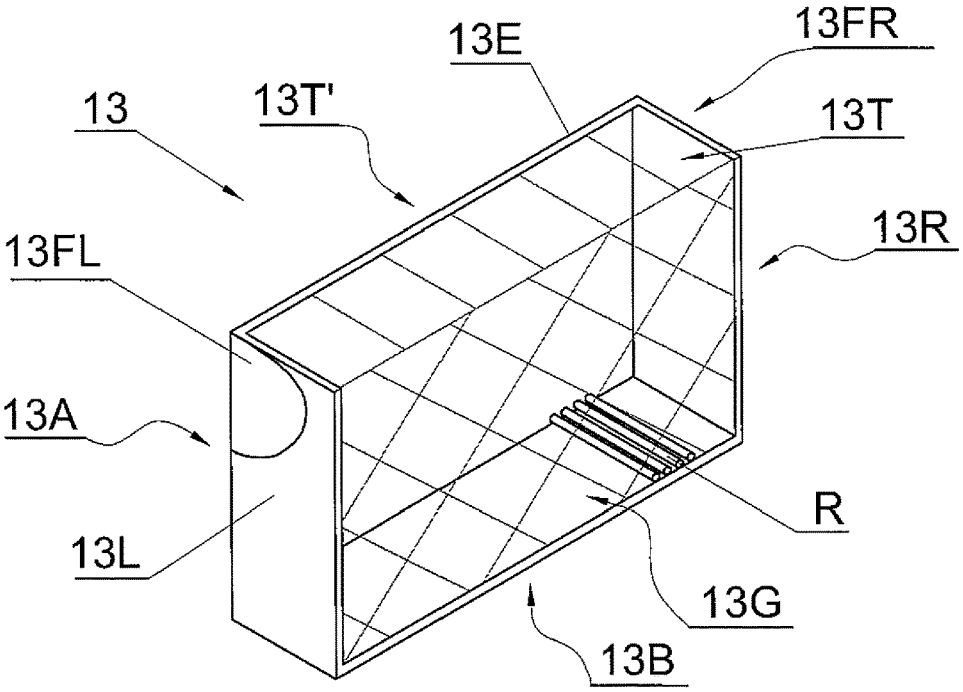
Figure 3:
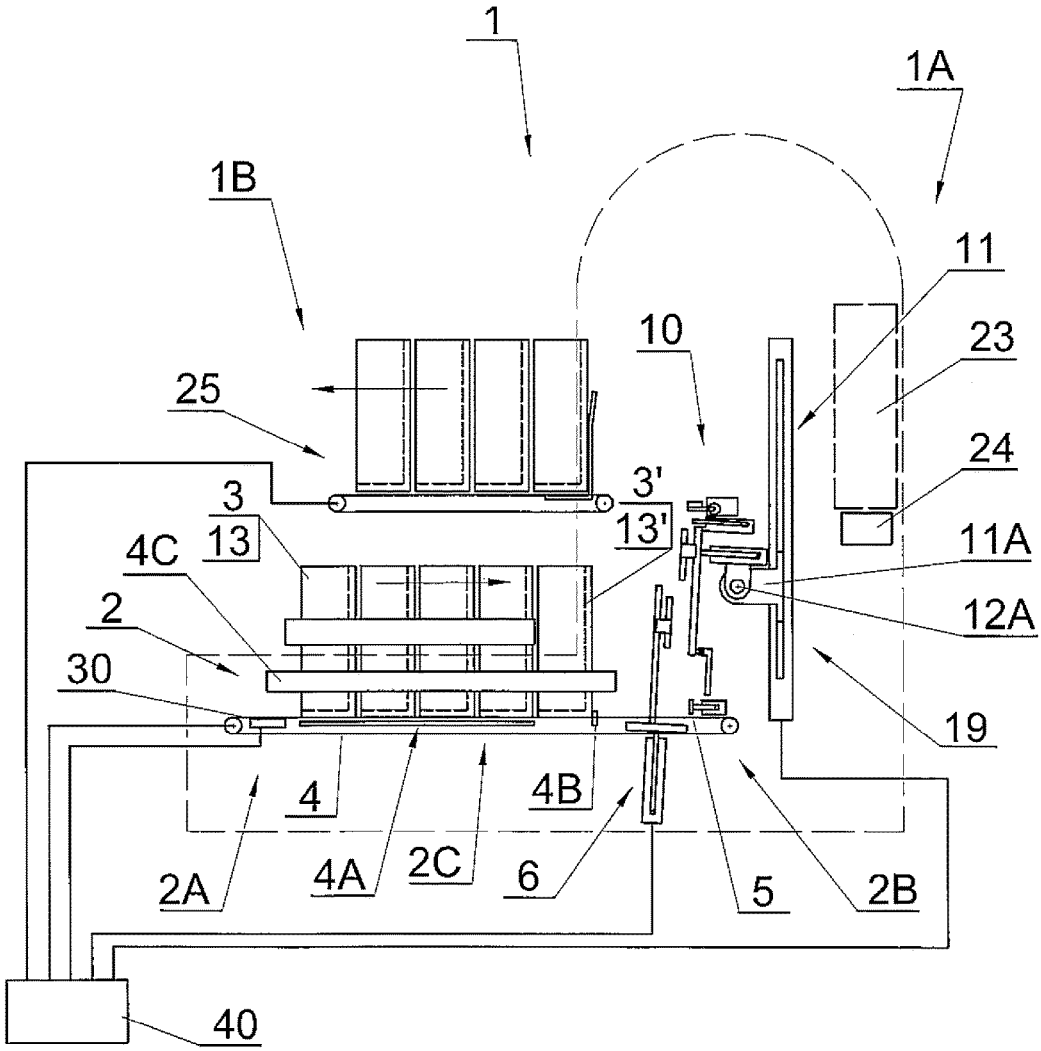
Figure 4:
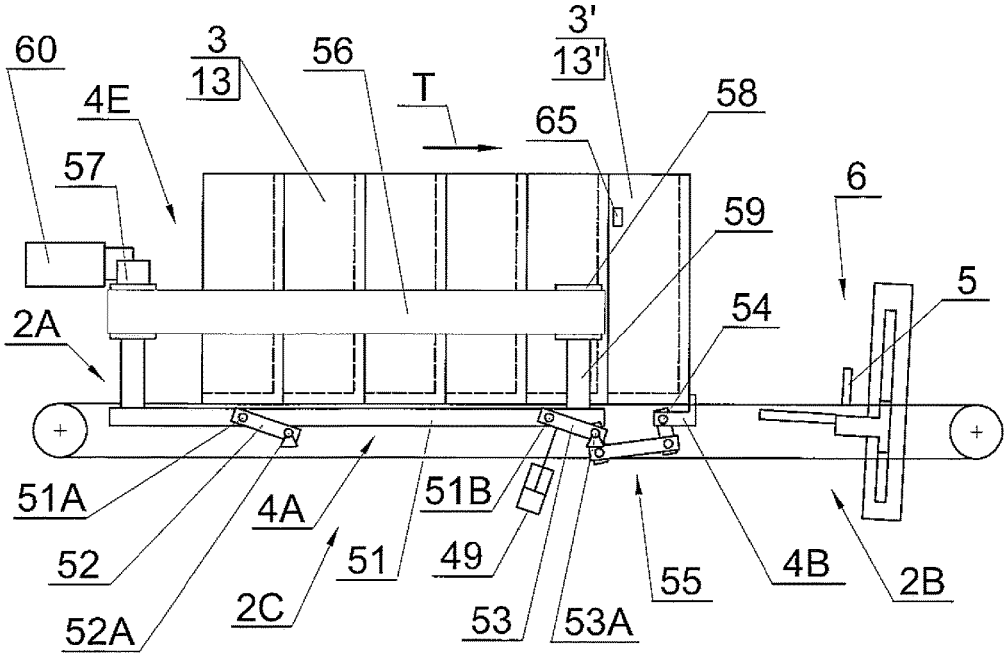
Figure 5:
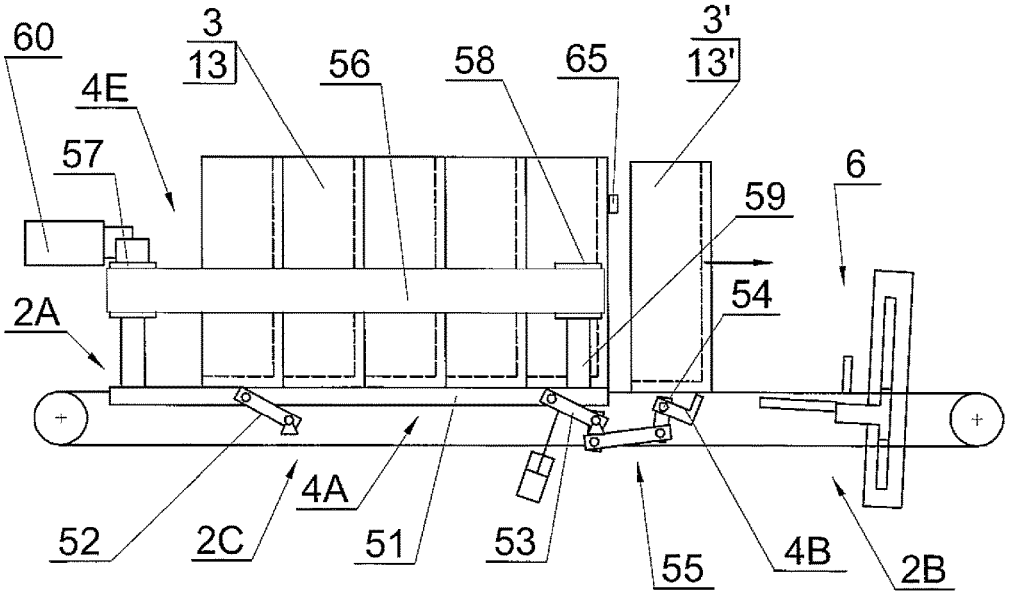
Figure 6:
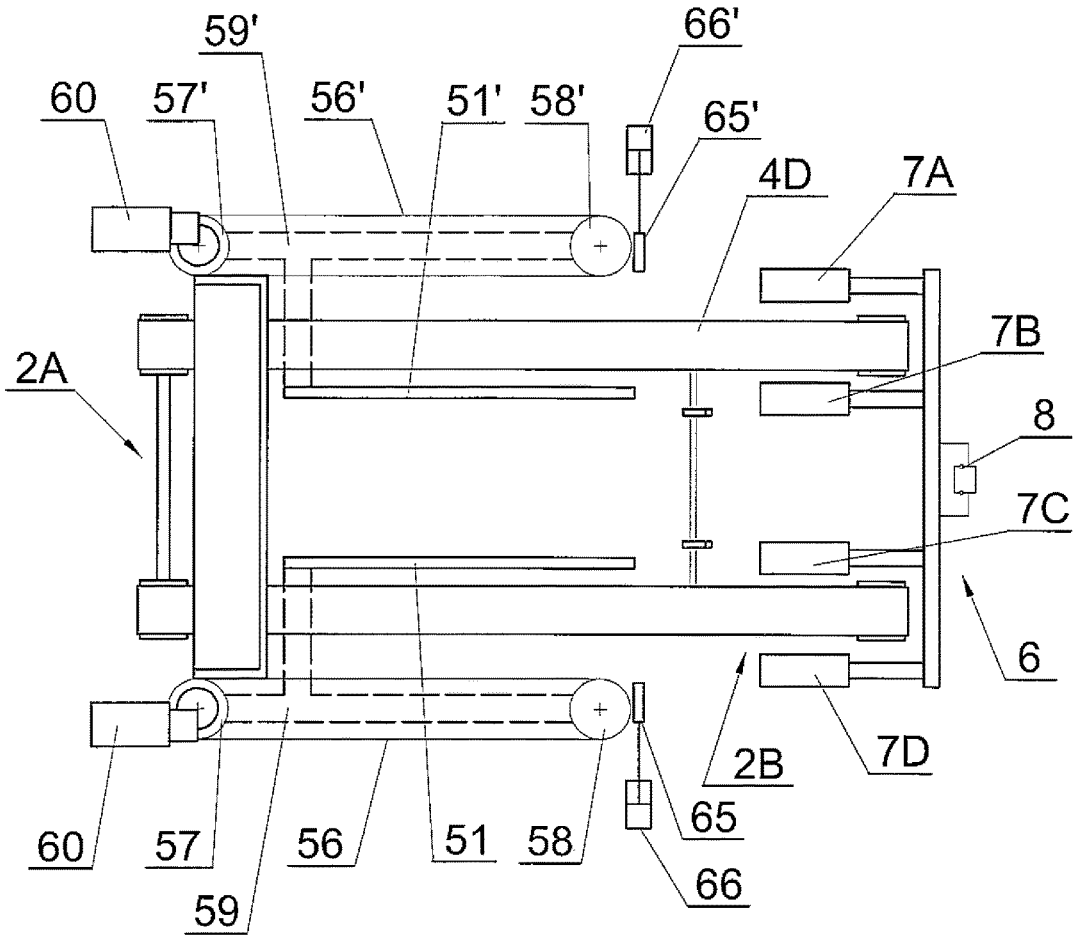
Figure 7:
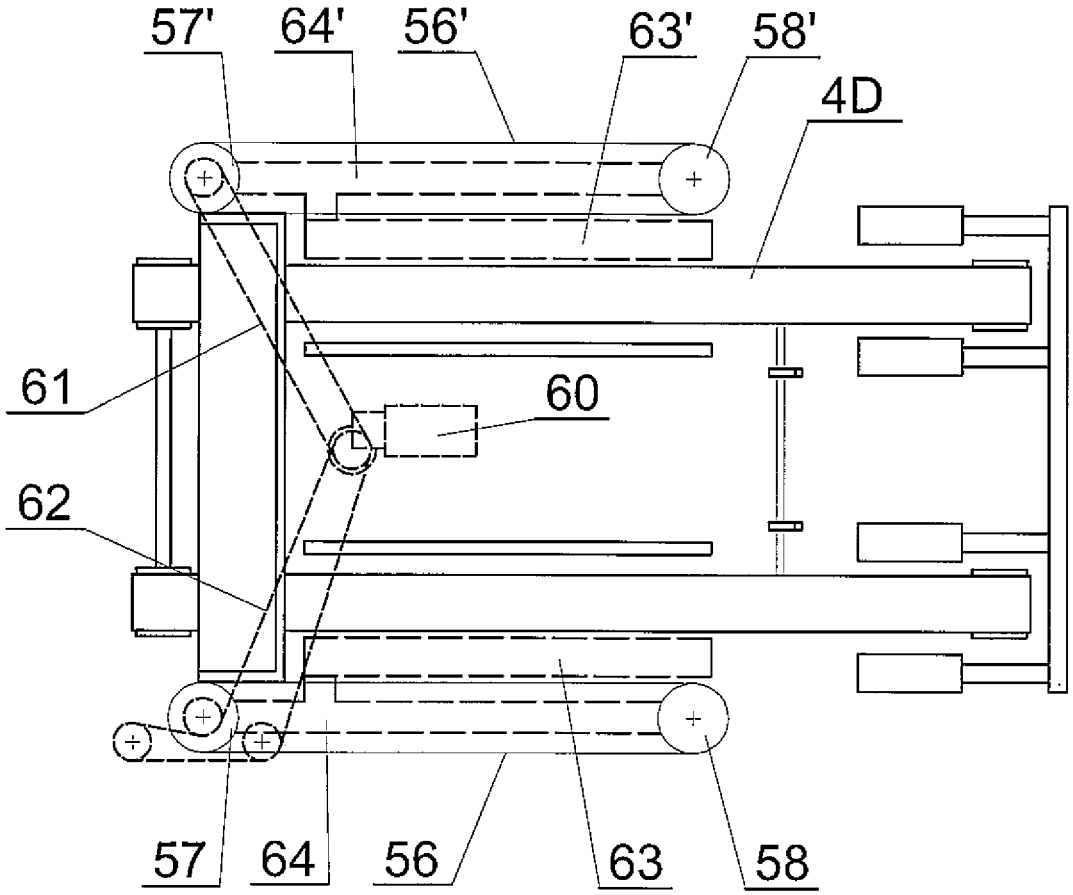

FIG. 2*a* shows a filled five-wall tray (of the first type) in a configuration of the second type in a perspective view, the back side of the tray being visible;

FIG. 2*b* shows a filled five-wall tray (of the first type) in a configuration of the second type in a perspective view, the front side of the tray being visible;

FIG. 3 shows an apparatus for emptying of trays for rod-like articles in a side view;

FIG. 4 shows a filled tray station in a side view, with all trays being situated on a bearing element of a conveyor;

FIG. 5 shows a filled tray station in a side view, the first tray being situated on the bearing element of the conveyor and the other trays being lifted;

FIG. 6 shows a filled tray station in a configuration with a separate motor driving each lateral belt in a top view;

FIG. 7 shows a filled tray station in a configuration with one motor driving the lateral belts in a top view;

In this description, the invention will be described with reference to a four-wall tray 3 shown in a simplified way in FIG. 1 and to a five-wall tray 13 shown in FIG. 2. Both trays 3, 13 were shown as filled in upright position, i.e. in such position in which the filled trays 3, 13 are placed on the filled tray station 2 of the filled tray emptying apparatus 1 shown in FIG. 3. The filled space of the trays 3, 13 shown in FIGS. 1 and 2 was marked by hatching with lines, with only several example rod like articles R lying on the bottom of the trays 3, 13. In such upright position, the filled trays 3, 13 are placed by the operator onto the filled tray station, whereas the operator holds the tray 3, 13 by the sidewalls with the inside of the tray being directed towards him. Such expressions as upper, bottom, lateral, front and back will refer to the position of the trays shown in FIGS. 1 and 2, with the front side, left lateral side and upper side of each of the trays 3, 13 being visible therein. The four-wall tray 3 has a bottom wall 3B on which its stands, a back wall 3A and two lateral walls, a left lateral wall 3L and a right lateral wall 3R, whereas the designation of the sides refers to the position in which the tray 3 can be seen by the operator putting a filled tray onto the filled tray station, with the open front side 3G of the trays 3 being directed towards him. The filling and the emptying of the tray 3 takes place through the open side 3T. The four-wall trays may be made of plastic or other suitable material ensuring an adequate rigidity and are usually designed for multiple uses.

The five-wall tray 13 has a bottom wall 13B on which it stands, a back wall 13A and two lateral walls, a left lateral wall 13L and a right lateral wall 13R. The five-wall tray 13 has a hinged upper wall 13T' which is designated as self-aligning relative to the back wall 13A of the tray 13 with which it is connected along the edge 13E. The upper wall 13T' has two swinging lugs, a left swinging lug 13FL and a right swinging lug 13FR, which are inserted for the time of transport into the slots in the corresponding lateral walls 13L and 13R. After putting the filled five-wall tray 13 onto the filled tray station, the operator lifts the upper wall 13T' so that the swinging lugs 13FL and 13FR pull out of the walls 13L and 13R and loosely hang down on the side outside the lateral walls 13L and 13R. FIGS. 2*a* and 2*b* show the five-wall tray 13 at a later stage of the emptying cycle of the five-wall tray 13. The upper wall 13T' is swung so as to allow emptying the five-wall tray 13 through the upper open side 13T of the five-wall tray. The filling of the five-wall tray 13 also takes place through the upper side 13T. Similar to the four-wall tray 3, the operator puts the five-wall tray 13 onto the filled tray station while holding the five-wall tray 13 with the open side 13G directed towards him. Five-wall trays 13 may be made of cardboard or other cheap material, are usually less rigid than the four-wall trays and are usually designed for a single use.

The tray 3, 13 emptying machine 1 described below, being a tray unloader, is adapted to empty both four-wall trays 3 and five-wall trays 13. For the sake of simplicity, the units belonging to the tray emptying apparatus 1 were shown in FIG. 3 in simplified terms without the drive mechanisms; the outer contour of the body of the apparatus 1 was shown with a dashed line. The tray emptying apparatus 1 is provided with a filled tray station 2 onto which the filled four-wall trays 3 or five-wall trays 13 designated for unloading are placed by the operator. From the filled tray station 2 the trays 3, 13 are fed as first filled trays 3', 13' in order to deliver them to the lifting unit 6, whereas a plurality of filled trays 3, 13 is collected on the filled tray station 2 (FIG. 4). The lifting unit 6 for lifting of the filled trays 3, 13 is provided with a multipart support 7A, 7B, 7C and 7D shown in FIG. 6 which may be inclined towards the front part 1A of the tray emptying apparatus 1. The lifting of the tray 3, 13 by the lifting unit 6 may be accomplished by means of any linear movement mechanism with electric or pneumatic drive. The lifting unit 6 lifts the filled tray 3, 13 to a height at which the turning unit 10 may grip the filled tray 3, 13. The turning unit 10 is adapted to turn the filled tray 3, 13 before unloading it at the filled tray emptying station 23. The turning unit 10 is attached to a rotating shaft 12 with the axis of rotation 12A on a slide 11A of the lifting unit 11. The turning unit 10 and the lifting unit 11 constitute a handling unit 19. During the tray 3, 13 emptying cycle the tray 3, 13 is lifted, turned and moved away from the axis of rotation 12A. The tray emptying apparatus 1 is provided with a filled tray emptying station 23 in the front part 1A of the apparatus 1 underneath which a conveyor 24 receiving the rod like articles R unloaded from the trays 3, 13 is situated. In the back part 1B of the tray emptying apparatus 1, an empty tray station 25 is situated. The tray emptying apparatus 1 was described in detail in the patent application P.417941 belonging to the applicant. The tray emptying apparatus 1 is provided with a controller 40 shown in FIG. 3 connected with individual units of the apparatus 1.

The filled tray station 2 shown in FIGS. 4 and 5 has a receiving part 2A onto which the trays 3, 13 are placed by the operator and a transferring part 2B from which the trays 3, 13 are picked up by any picking-up unit. In the embodiment shown in FIGS. 4 and 5 the picking-up unit constitutes the lifting unit 6 of the tray emptying apparatus 1, whereas the picking-up unit may be any tray conveyor. Between the receiving part 2A and the transferring part 2B of the filled tray station 2 a storage and conveying unit 2C is situated. The storage and conveying unit 2C is provided with a conveyor 4 having two bearing elements 4D, for example belts or chains with flat bearing surfaces (FIG. 6). The trays 3, 13 may be conveyed by means of any bearing elements with a flat bearing surface. The conveyor 4 is adapted to convey the trays 3, 13 in such a way that during conveying the trays 3, 13 abut against one another or are conveyed individually. The filled tray station 2 may be provided with lateral guides 4C situated on two sides of the trays 3, 13 conveyed along the filled tray station 2. The lateral guides 4C are positioned convergently in the feeding direction i.e. from the back part constituting the receiving part 2A to the front part constituting the transferring part 2B, whereas the convergence of the lateral guides 4C may be adjusted depending on the kind of the tray 3, 13, for example on the rigidity of the tray 3, 13. Furthermore, the storage and conveying unit 2C is provided with a tray separation mechanism 4A, in the embodiment the first tray 3', 13' is separated from the trays collected on the conveyor 4. The tray separation mechanism 4A has lifting elements 51 attached by means of joints 51A, 51B on levers 52, 53, which are pivotally attached to joints 52A and 53A. The swinging movement of the lever 52, 53 is mechanically coupled with the movement of the limiter 4B being self-aligning and attached to the axis 54 by means of a four-bar linkage 55 or another mechanism. The tray separation mechanism 4A is driven by an actuator 49. Both the lifting elements 51 and the limiter 4D make a swinging movement, they may be adapted to make a linear movement, for example they may be moved by independent actuators. A supporting mechanism 4E adapted to support the sidewalls 3L, 3R, 13L, 13R of the trays 3, 13 is coupled with the tray separation mechanism 4A. The supporting mechanism 4E is provided with two lateral belts 56 remaining in contact with the sidewalls 3L, 3R, 13L, 13R of the trays 3, 13, whereas the lateral belts 56 are wrapped around the rollers 57 and 58. In the embodiment shown, the roller 57 is driven by a motor 60. The supporting mechanism 4E is mechanically coupled with the lifting elements 51, for example by means of brackets 59 marked in FIG. 6 with dashed lines. The lateral belts 56, 56' make up-and-down movements corresponding to the movement of the belts 4D. As shown in FIG. 6, each lateral belt 56, 56' may be driven by a separate motor 60, whereas the speed of the belts 56, 56' is the same as the speed of the belts 4D, and the movement of the lateral belts 56, 56' is synchronised with the movement of the belts 4D so that each tray 3, 13 is held at four points and may be stably conveyed along the storage and conveying unit 2C. In addition, the mechanism 4E may be provided with two support elements 65, 65' which are conveyed by means of the actuators 66, 66', whereas in FIGS. 4 and 5 they were shown without the actuators 66, 66'. The support elements 65, 65'are used to stabilise the position of the trays 3, 13 lifted on the lifting elements 51, 51' and to support the trays 3, 13 to prevent them from falling over in the direction of the transferring part 2B of the station 2. The support elements 65, 65' together with the actuators 66, 66' may be stationary or may follow the movement of the trays 56, 56' and the lifting elements 51, 51' in the up-and-down direction. FIG. 7 shows an embodiment of the driving mechanism of the lateral belts 56, 56' with the use of one motor 60 and toothed belts 61 and 62. The driving elements may be situated underneath the filled tray station 2. The lateral belts 56, 56' may be positioned convergently in the feeding direction i.e. from the back part constituting the receiving part 2A to the front part constituting the transferring part 2B, whereas the convergence of the lateral belts 56, 56' may be adjusted depending on the kind of the tray 3, 13, for example on the rigidity of the tray 3, 13, whereas the lateral belts 56, 56' remain in contact with the trays 3, 13 during the lifting of the trays 3, 13. The lifting elements 51, 51' for lifting of the trays collected in the storage and conveying unit 2C have the form of bars in the embodiment shown in FIGS. 4-6. An alternative solution is shown in FIG. 7 where the lifting elements 63, 63' have the form of plates and are situated outside of the belts 4D. The supporting mechanism 4E may be supported by means of the brackets 64, 64'.

During the operation of the apparatus 1 the operator places the trays 3, 13 for unloading in the receiving part 2A on the belts 4D and between the lateral belts 56, 56'. The tray 3, 13 which has been placed there is conveyed in the direction T towards the transferring part 2B as far as to the limiter 4B or to another tray which was previously placed in the filled tray station 2. The tray 3, 13 is held at four points, two points on the bottom wall of the tray and respectively one point on each sidewall of the tray so that even such trays in which short rod-like articles R, for example with the length of 60 mm, are collected, do not fall over when being conveyed. FIG. 4 shows a situation where all trays 3, 13 collected on the conveyor 4 have been stopped by means of the limiter 4B. FIG. 5 shows a situation where the first tray 3', 13' is being conveyed to the transferring part 2B, whereas all other trays 3, 13 have been lifted so that their bottom walls 3B, 13B do not have any contact with the drive elements 4D. The first filled tray 3', 13' of all filled trays 3, 13 standing in the station 2 is fed after all filled trays 3, 13 have been lifted from the conveyor 4 by means of the lifting elements 51 except the first tray 3', 13' which is conveyed by the belts 4D of the conveyor 4 to the transferring part 2B. Once the first filled tray 3', 13' has been conveyed to the transferring part 2B the belts 4D are stopped and the lifting elements 51, 51' of the tray separation mechanism 4A are lowered, the previously lifted trays 3, 13 are put onto the belts 4D of the separation mechanism 4, and the limiter 4B is lifted. The belts 4D and the lateral belts 56 and 56' are restarted. The filled tray station 2 may be provided with an adjustable support element 5, the adjustment of position of the support element 5 is needed to allow stopping the filled tray 3', 13' at a place from which it may be picked up or lifted by the lifting unit 6. Once the trays 3', 13' have been pushed to abut against the support element 5 the belts 4D are switched off. In the embodiment shown, the tray 3', 13' is being lifted by means of a multipart support 7 comprising the elements 7A, 7B, 7C and 7D belonging to the lifting unit 6 which makes the up-and-down movement on the guide 8.

In the embodiment shown, the trays 3, 13 are manually placed in the receiving part 2A of the filled tray station 2. The trays 3, 13 may be placed on the filled tray station 2 manually or by means of any feeding apparatus, for example a conveyor, manipulator or robot. The filled trays may be received by the conveyor 4 or by the lifting unit 6.

The invention claimed is:

1. An apparatus (1) for emptying four-wall trays (3) or five-wall trays (13) filled with rod-like articles (R) of the tobacco industry, whereas the upper wall (13T') of the five-wall trays (13) is a swinging wall, said apparatus (1) provided with a filled tray station (2), a turning unit (10) to turn a filled tray (3, 13), a lifting unit (11) to lift the turning unit (10),
a filled tray (3, 13) emptying station (23), and
an empty tray station (25),
characterised in that
the filled tray station (2) is provided with
lateral belts (56, 56') adapted to support sidewalls (3L, 3R, 13L, 13R) of the trays (3, 13), whereas the lateral belts (56, 56') are configured to make an up-and-down movement in synchronization with bearing elements (4D) when lifting elements (51, 51', 63, 63') lift each of the filled trays (3,13), except for a first filled tray (3, 13), from the bearing elements (4D) of the filled tray station (2) and put, the same said trays (3, 13) back on the bearing elements (4D).

2. The apparatus of claim 1, wherein the filled tray station (2) further comprises a receiving part (2A) to receive the filled trays (3, 13); and a storage and conveying unit (2C) containing the filled trays (3, 13), provided with a conveyor (4) to convey the filled trays (3, 13) and a tray separation mechanism (4A) to separate the first tray filled (3', 13') from other trays filled (3, 13) collected on bearing elements (4D) of the conveyor (4), whereas a tray separation mechanism (4A) is provided with the lifting elements (51, 51', 63, 63') adapted to lift each of the filled trays (3, 13), except for the first filled tray (3, 13), from the bearing elements (4D) of the conveyor (4).

3. The apparatus (1) as in claim 2 characterised in that the lifting elements (51, 51', 63, 63') have the form of longitudinal bars or plates supporting bottom walls (3B, 13B) of the trays filled (3, 13).

4. The apparatus (1) as in claim 3 characterised in that the lifting elements (51, 51', 63, 63') are adapted to make a swinging movement.

5. The apparatus (1) as in claim 3 characterised in that the lifting elements (51, 51', 63, 63') are adapted to make a linear movement.

6. The apparatus (1) as in claim 2 characterised in that the tray separation mechanism (4A) is provided with a limiter (4B) for filled trays (3, 13) collected in the filled tray station (2), being coupled with the movement of the lifting elements (51, 51', 63, 63').

7. The apparatus (1) as in claim 6 characterised in that the limiter (4B) is adapted to make a swinging movement.

8. The apparatus (1) as in claim 6 characterised in that the limiter (4B) is adapted to make a linear movement.

9. The apparatus (1) as in claim 2 characterised in that the lateral belts (56, 56') are positioned convergently.

10. The apparatus (1) as in claim 2 characterised in that the lateral belts (56, 56') are positioned parallel to each other.

11. The apparatus (1) as in claim 2 characterised in that the conveyor (4) is a belt conveyor.

12. The apparatus (1) as in claim 2 characterised in that the conveyor (4) is a chain conveyor.

13. The apparatus (1) as in claim 2 characterised in that the speed of the lateral belts (56, 56') is synchronised with the speed of the bearing elements (4D) of the conveyor (4).

* * * * *